US008063456B2

(12) United States Patent
Aksyuk et al.

(10) Patent No.: US 8,063,456 B2
(45) Date of Patent: Nov. 22, 2011

(54) MECHANICAL SWITCH WITH A CURVED BILAYER

(75) Inventors: Vladimir Anatolyevich Aksyuk, Westfield, NJ (US); Omar Daniel Lopez, Summit, NJ (US); Flavio Pardo, New Providence, NJ (US); Maria Elina Simon, New Providence, NJ (US)

(73) Assignee: Alcatel Lucent, Paris (FR)

( * ) Notice: Subject to any disclaimer, the term of this patent is extended or adjusted under 35 U.S.C. 154(b) by 0 days.

(21) Appl. No.: 11/519,623

(22) Filed: Sep. 12, 2006

(65) Prior Publication Data

US 2008/0060920 A1 Mar. 13, 2008

(51) Int. Cl.
*H01H 51/22* (2006.01)

(52) U.S. Cl. ..... 257/415; 257/E45.002

(58) Field of Classification Search ..... None
See application file for complete search history.

(56) References Cited

U.S. PATENT DOCUMENTS

| | | | | |
|---|---|---|---|---|
| 5,233,459 | A | 8/1993 | Bozler et al. | 359/230 |
| 5,619,061 | A | 4/1997 | Goldsmith et al. | |
| 5,619,177 | A | 4/1997 | Johnson et al. | 337/140 |
| 5,994,159 | A | 11/1999 | Aksyuk et al. | 438/52 |
| 6,396,368 | B1 * | 5/2002 | Chow et al. | 333/262 |
| 6,646,215 | B1 * | 11/2003 | Nelson | 200/181 |
| 7,268,653 | B2 | 9/2007 | Bouche | 335/78 |
| 7,280,015 | B1 * | 10/2007 | Schaffner et al. | 335/78 |
| 2003/0058069 | A1 * | 3/2003 | Schwartz et al. | 335/78 |
| 2003/0222740 | A1 * | 12/2003 | Ruan et al. | 335/78 |
| 2005/0001701 | A1 * | 1/2005 | Shirakawa | 335/78 |
| 2006/0192641 | A1 * | 8/2006 | Charvet | 335/78 |

FOREIGN PATENT DOCUMENTS

| | | | |
|---|---|---|---|
| FR | 1 562 207 | A1 | 8/2005 |
| JP | 8-213803 | A | 8/1995 |
| WO | WO 97/29538 | A | 8/1997 |

OTHER PUBLICATIONS

Lopez, D. et al., "Optical MEMS Design for Telecommunications Applications," Solid-State Sensor, Actuator, and Microsystems Workshop, Hilton Head Island, South Carolina, pp. 1-6, (Jun. 2-6, 2002).

Chou, T-K. A. et al., "Billion-Cycle ULV Electrostatic RF MEMS Switch," Solid-State Sensors, Actuators, and Microsystems Workshop, Hilton Head Island, South Carolina, pp. 78-81, (Jun. 4-6, 2002).

Aksyuk, V.A. et al., "Stress-induced curvature engineering in surface-micromachined devices," published in Proceedings of Design, Test, and Microfabrication of MEMS and MOEMS, Paris, SPIE, vol. 3680, 12 pages, (1999).

Aksyuk, V.A. et al., "Low Insertion Loss Packaged and Fiber-Connectorized Si Surface-Micromachined Reflective Optical Switch," Solid-State Sensor and Actuator Workshop, pp. 79-82, Hilton Head Island, South Carolina, Jun. 8-11, 4 pages, (1998).

Aksyuk, V.A. et al., "Beam-Steering Micromirrors for Large Optical Cross-Connects," Journal of Lightwave Technology, vol. 21, No. 3, pp. 634-642, (Mar. 2003).

PCT International Search Report dated Apr. 3, 2008 (PCT/US2007/018812) 2 pages.

* cited by examiner

*Primary Examiner* — Benjamin Sandvik
(74) *Attorney, Agent, or Firm* — Hitt Goines, PC

(57) ABSTRACT

An apparatus includes a mechanical switch. The mechanical switch includes a bilayer with first and second stable curved states. A transformation of the bilayer from the first state to the second state closes the switch.

14 Claims, 10 Drawing Sheets

MECHANICAL SWITCH WITH A CURVED BILAYER

BACKGROUND

1. Field of the Invention

The invention relates to micro-mechanical switches and to methods of making and operating micro-mechanical switches.

2. Discussion of the Related Art

A mechanical switch is an electrical switch that has an electrical connection that moves during the transformation of the switch between the open-switch and closed-switch states. In many mechanical switches a controllable electro-mechanical device drives the transformation between the open-switch and closed-switch states. Often, the electro-mechanical device must be continuously powered in one or both these states. One example of such a mechanical switch is an ordinary electro-mechanical relay in which an electromagnet typically holds the switch contacts together in the closed-switch state. The need to continuously power such an electro-mechanical control device in one or both switch states may lead to high power costs for using such a switch.

BRIEF SUMMARY

Various embodiments provide apparatus that includes a mechanical switch in which different stable curved configurations of a bilayer support the different switch states, i.e., the open and closed switch states. In some of the mechanical switches, electrical power is not needed to maintain the closed-switch and open-switch states.

In one aspect, an apparatus includes a mechanical switch. The mechanical switch includes a bilayer with first and second stable curved states. A transformation of the bilayer from the first state to the second state closes the switch.

In another aspect, an apparatus includes a substrate having a top surface, a plurality of electrodes located along the top surface and fixed to the substrate, and a bilayer attached by one or more posts to the substrate. The bilayer is capable of transforming between first and second stable curved states. The bilayer has different edges that are curved in the first and second stable curved states.

In some embodiments, the above-described apparatus may include an electrical jumper located on the bilayer and first and second electrical lines located over the top surface and fixed to the substrate. The electrical jumper is configured to electrically connect the lines in response to the bilayer being in the first curved state and to not short the lines in response to the bilayer being in the second curved state.

In another aspect, a method of manufacturing a mechanical switch includes forming a stressed bilayer over a top surface of a substrate such that a connector physically connects the bilayer to the substrate and releasing the bilayer by removing a sacrificial material layer located between the bilayer and the top surface. A surface of the released bilayer has a curved shape.

BRIEF DESCRIPTION OF THE DRAWINGS

In the Figures and text, like reference numerals indicate elements with similar structures and/or functions.

In the Figures, the relative dimensions of some features may be exaggerated to more clearly illustrate one or more of the structures therein.

Herein, various embodiments are described more fully by the Figures and the Detailed Description of Illustrative Embodiments. Nevertheless, the inventions may be embodied in various forms and are not limited to the embodiments described in the Figures and Detailed Description of Illustrative Embodiments.

DETAILED DESCRIPTION OF ILLUSTRATIVE EMBODIMENTS

A resilient planar bilayer whose two layers have dissimilar compositions is often subject to an internal stress gradient. The internal stress gradient can cause the planar state of a bilayer with a polygonal shape to be unstable. For that reason, such a planar bilayer can spontaneously buckle to become curved. In a buckled or curved state, the bilayer curves about an axis, e.g., an axis passing through midpoints of opposite edges of the bilayer. If the bilayer has a polygonal shape with an even number of edges, the bilayer may have more than one stable curved state.

Figure 1:
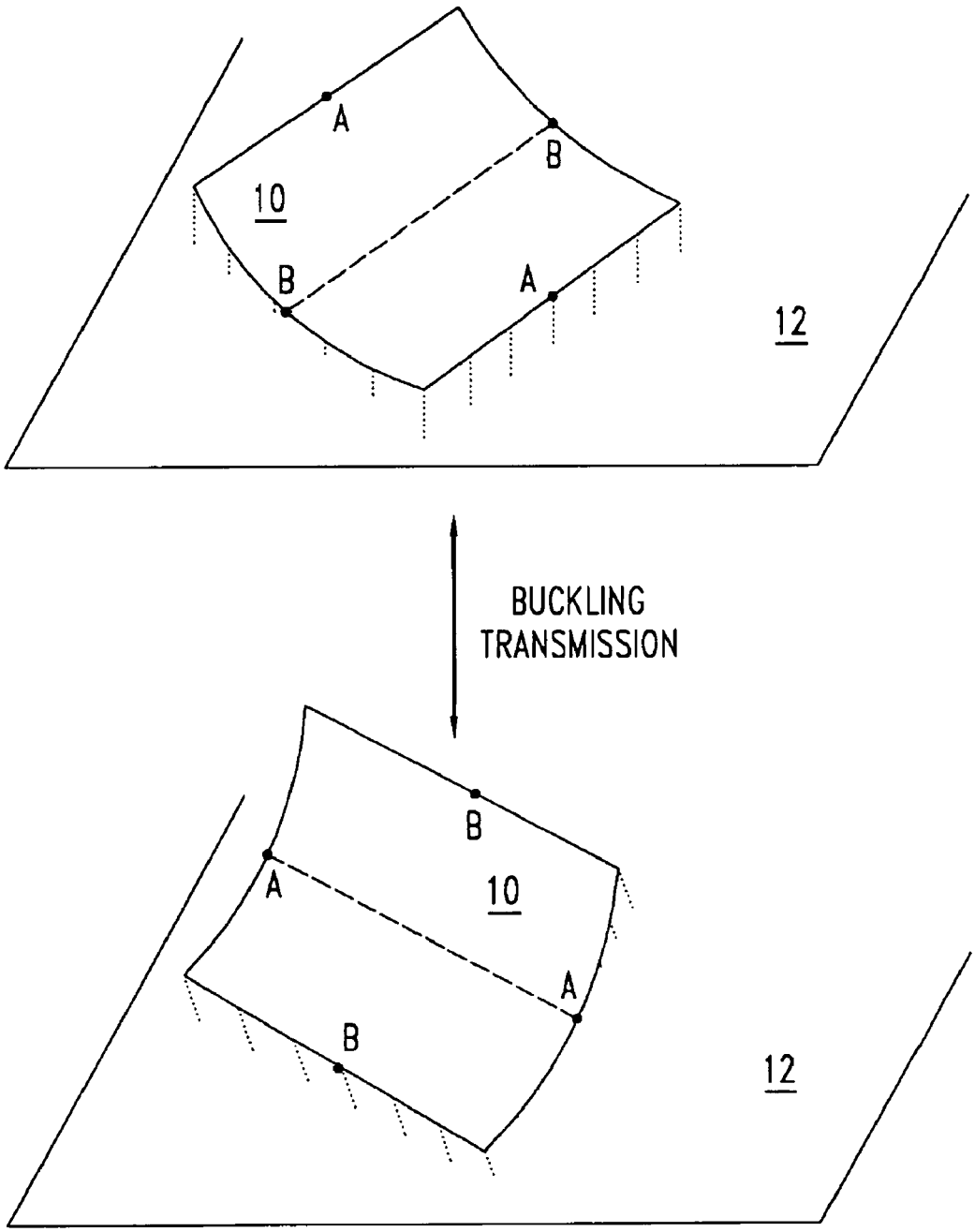
FIG. 1 is an oblique view that illustrates the two stable buckled or curved states of an exemplary resilient bilayer having a rectangular form.

FIG. 1 illustrates the stable curved states of a resilient bilayer 10 that is located on a planar surface 12. The resilient bilayer 10 has a rectangular shape or a square shape when flattened. In the resilient bilayer 10, the center points of one pair of opposite edges are indicated by "A", and the center points of the other pair of opposite edges are indicated by "B".

The resilient bilayer 10 has two stable curved states as illustrated in the upper portion and the lower portion, respectively, of FIG. 1. The upper portion of FIG. 1 shows the first stable curved state in which the resilient bilayer 10 is in contact with the planar surface 12 along the entire length of the bilayer's midline B-B. In this curved state, opposite edges of the resilient bilayer that include the "A" midpoints are raised above the planar surface 12 as indicated by vertical dotted lines, and the edges of the bilayer with the midpoints "B" are curved. In the second stable curved state, the resilient bilayer 10 is in contact with the planar surface 12 along the entire length of the bilayer's midline A-A. In this curved state, opposite edges of the resilient bilayer that include the "B" midpoints are raised above the planar surface 12 as indicated by vertical dotted lines, and the edges of the bilayer with the midpoints "A" are curved. Thus, each of the stable curved states places one midline of the resilient bilayer 10 in contact with the planar surface 12. The stable curved states of a bilayer are defined by the polygonal shape of the bilayer.

FIG. 1 suggests a method for transforming the resilient polygonal bilayer 10 between its two stable curved states. The method uses the fact that that each curved state positions one midline, i.e., A-A or B-B, in contact with the planar support surface 12 along the entire length of the line. In particular, a transformation of the resilient polygonal bilayer 10 from the first curved state to the second curved state must bring the midline, i.e., A-A or B-B, which is not initially in contact with the planar surface 12, into contact with the planar surface 12. Thus, the method applies a force to resilient bilayer 10 that will bring the entire length of the A-A midline near or in contact with the planar surface 12 to transform the polygonal bilayer from the upper stable curved state to the lower stable curved state in FIG. 1. Similarly, the method applies a force to resilient bilayer 10 that will bring the entire length of the B-B midline near to or in contact with the planar surface 12 to transform from the resilient bilayer 10 from the lower stable curved state to the upper stable curved state in FIG. 1.

The forces needed to transform the polygonal resilient bilayer 10 between the two stable curved states of FIG. 1 may be applied electro-statically. Such electro-static forces operate various embodiments of micro-mechanical switch 20 that are illustrated by FIGS. 2A-2C, 3, 4, 5A, and 5B. In each embodiment, one stable curved state of a bilayer corresponds to the closed-switch-state, and one or more other stable curved states of the same bilayer correspond to an open-switch state.

In each of the embodiments, the micro-mechanical switch 20 includes a substrate 22, a resilient bilayer 24, an array 28 of control electrodes, a dielectric layer 30, a conducting electrical jumper 32, and input and output (I/O) electrical lines 34. The different embodiments of FIGS. 2A, 2B, and 2C have different structures for the conducting electrical jumper 32 and/or the I/O electrical lines 34.

The substrate 22 is a rigid support structure for micro-electronics fabrication. The substrate 22 may be, e.g., a crystalline silicon wafer-substrate, a rigid dielectric substrate, or a crystalline semiconductor wafer-substrate that has been covered by one or more insulating dielectric layers. The substrate 22 has a top surface 26 over which other elements of the mechanical switch 20 are located. The top surface 26 may be planar or may be substantially planar, i.e., have small variations from being flat.

The resilient bilayer 24 has a substantially polygonal lateral shape, wherein the polygon has an even number of edges. For example, the resilient bilayer 24 may have the shape of a polygon with eight, six, or four sides and may or may not have small edge and/or corner irregularities that cause its lateral shape to not be a perfect polygon. An exemplary resilient bilayer 24 is a square or rectangle whose edge-lengths are between about 100 μm and about 500 μm. The resilient bilayer 24 is formed of two integrally bonded thin layers 36, 38 that have different compositions. The bottom layer 36 is a conducting layer, e.g., heavily doped polycrystalline silicon (polysilicon) with a thickness of 1 micrometer (μm) to 3 μm. The top layer 38 is an inorganic dielectric layer, e.g., a silicon nitride layer with a thickness of about 0.3 μm to about 1.0 μm, i.e., 0.5 μm of $Si_3N_4$. Since the bonded thin layers 36, 38 have very different compositions, they may produce a net stress gradient when the resilient bilayer 24 is flat. For example, in a silicon nitride/polysilicon bilayer, the polysilicon layer can produce a compressive stress, and the silicon nitride layer can produce a tensile stress so that the combination produces a net stress gradient in the bilayer 24 when flat. Such a net stress gradient causes the resilient bilayer 24 to spontaneously buckle into one of a plurality of stable curved states (not shown in FIGS. 2A-2C, 3, and 4). For the shown substantially rectangular or square resilient bilayer 24 of FIG. 3, the two curved states have shapes that are substantially similar to those of the resilient bilayer 10 as shown in FIG. 1.

The resilient bilayer 24 also includes one or more projections from its bottom conducting surface as illustrated in FIGS. 2A-2C, 3, and 4.

The projections include a regular array of short stops 42 that are configured to physically stop the bottom conducting layer 36 from electrically shorting with the underlying control electrodes of the array 28 when a portion of the bilayer 24 is pulled near to the substrate 22. If the bottom conducting layer 36 is formed of polysilicon, the stops 42 may be short polysilicon posts from the polysilicon bottom conducting layer 36. In such an embodiment, the stops 42 may be laterally aligned with electrically isolated raised areas 44, e.g., short polysilicon posts, as illustrated in FIGS. 2A-2C, 5A, and 5B. The raised areas 44 are fixed to the planar top surface 26 of the substrate 22.

The projections include a central connector 40 that both physically anchors the center of the resilient bilayer 24 to the substrate 22 and provides an electrically conducting path between the conducting bottom layer 36 of the resilient bilayer 24 and the substrate 22. The connector 40 may be a spring or may be one or more rigid posts. In embodiments in which the connector 40 is a spring, the spring provides a compression force that pulls the resilient bilayer 24 towards the substrate 22. In embodiments in which the connector 40 is one or more rigid posts, the one or more posts fix the center of the bilayer 24 rigidly above the substrate 22. In exemplary embodiments, the connector 40 is made of, e.g., heavily n-type or p-type doped polysilicon and may have a diameter of about 3 μm to about 5 μm. The connector 40 may have a larger lateral size if it is a compression spring. The connector 40 may also be formed as a projection from the heavily doped polysilicon bottom conducting layer 36 of the resilient bilayer 24.

The array 28 of control electrodes forms a planar structure that is located over the planar top surface 26 and is rigidly fixed thereto. The array 28 is segmented into operating groups A, B, and optionally includes guard groups O1, O2 as illustrated for a rectangular/square geometry of the resilient bilayer 24 in FIGS. 5A and 5B. Each operating group A, B, O1, O2 includes a pair of control electrodes that are symmetrically located on opposite sides of the central connector 40. Each electrode is separated from its neighbors by an electrically insulating gap. The electrically insulating gap may or may not be filled with dielectric. In the illustrated exemplary embodiment, the groups A, B, O1, O2 of control electrodes are formed of heavily doped polysilicon structure. The control electrodes of the operating groups A, B are located around or near the mid-regions of the edges of the resilient bilayer 24, and the control electrodes of the guard groups O1, O2 are located around the corners between the edges of the resilient bilayer 24.

Figure 5A:
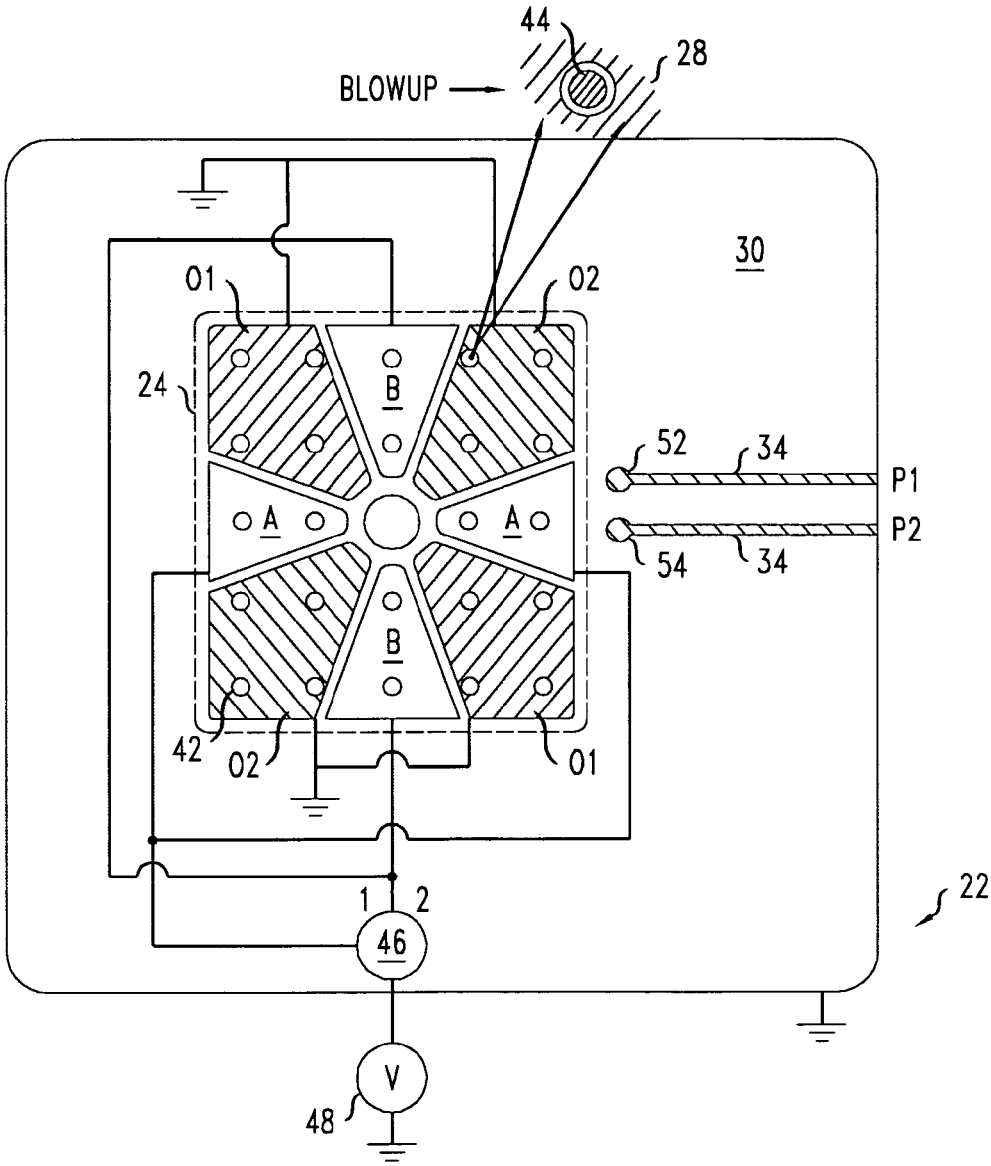
FIG. 5A is a top view of the surface that faces and is located below the bilayer in one embodiment of the micro-mechanical switches of FIGS. 2A-2C.

As schematically indicated in FIG. 5A for an exemplary square shape of the resilient bilayer 24, both electrodes of each group A, B, O1, and O2 are electrically shorted together. For that reason, both electrodes of each operating group A, B, and both electrodes of each guard group O1, O2 are maintained at substantially the same value of the electrical potential. The electrodes of operating group A connect, e.g., to one output 1 of a 1×2 switch 46, and the electrodes of operating group B connect to the other output 2 of the 1×2 switch 46. The 1×2 switch 46 may be on or off the substrate 22. The 1×2 switch 46 is configured to switchably connect one of its outputs 1, 2 to an external voltage source 48. Thus, the voltage source 48 can apply a voltage to either the control electrodes of the operating group A or to the control electrodes of the operating group B. The control electrodes of the guard groups O1, O2 are electrically connected to a device ground so that no voltage is applied thereto even when a voltage is applied to the control electrodes of the operating group A or the operating group B. Since the control electrodes of the guard groups O1, O2 are grounded, substantial electrostatic forces are not typically applied to corners of the resilient bilayer 24. Instead, substantial electrostatic forces are applied near central regions of the edges of the conducting bilayer 24 and along midlines through opposite edges of the resilient conducting bilayer 24.

As shown schematically in FIG. 5A, holes may be located in and/or between the control electrodes. The holes include the raised areas 44, which vertically aligned with the stops 42 on the conducting bottom side of the resilient bilayer 24. Thus, the stops 42 can make physical contact with the raised areas 44 when surrounding portions of the resilient bilayer 24 are pulled near the substrate 22. The raised areas 44 may also formed of doped polysilicon. In FIG. 5A, a blowup illustrates one of the raised areas 44. The blowup shows that the raised area 44 is separated from the surrounding electrodes of the groups A, B, O1, O2 by a gap. Due to the gap between each raised area 44 and the adjacent control electrode(s), the bottom conducting layer 36 of the resilient bilayer 24 will not be electrically shorted to the control electrodes of the array 28 during operation of the mechanical switch 20 even if some of the stops 42 of the resilient bilayer 24 make contact with some of the raised areas 44. The gaps may be empty or may be filled with a dielectric, e.g., silicon nitride.

The thin dielectric layer 30 insulates the control electrodes of the array 28, the I/O electrical lines 34, the raised areas 44, and the connection pads 52, 54 from the underlying substrate 22. In exemplary embodiments, the dielectric layer 30 may be formed of dense silicon dioxide, which has been, e.g., formed by thermal oxidation, or may be formed of silicon nitride, e.g., 0.3 μm to 1.0 μm of silicon nitride.

Figure 2A:
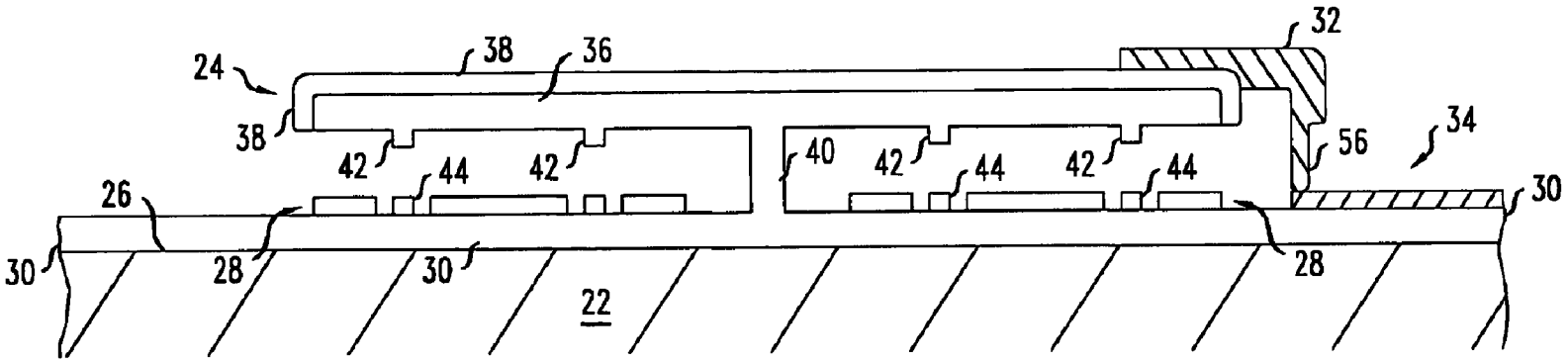
FIGS. 2A-2C are cross-sectional views of three embodiments of micro-mechanical switches that use transformations of a bilayer between different stable curved states to change the open or closed switch-state of the micro-mechanical switches.
Figure 2B:
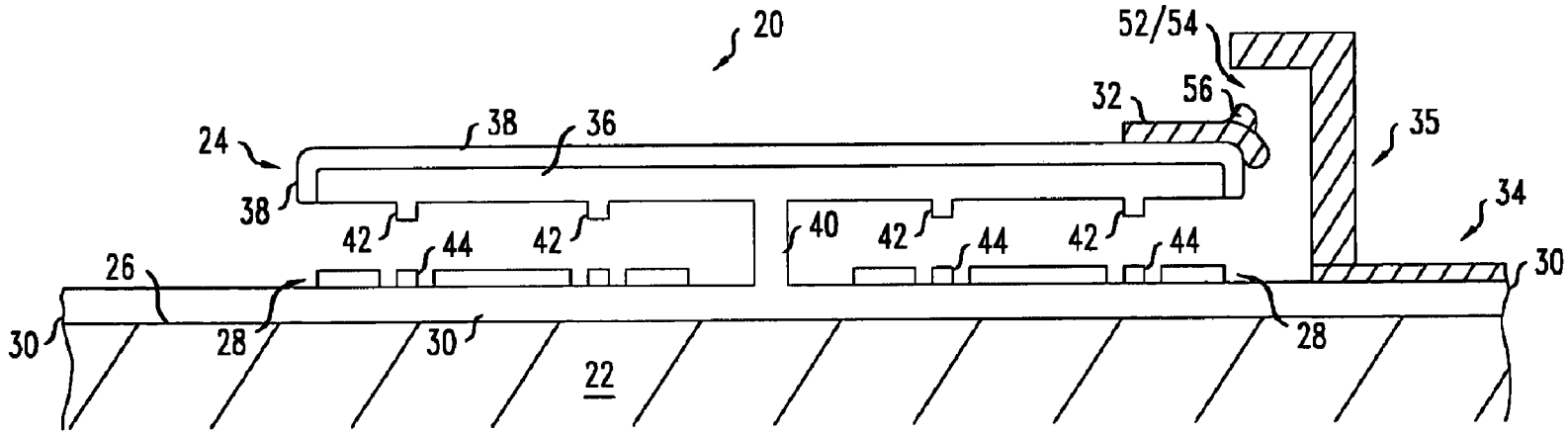
Figure 2C:
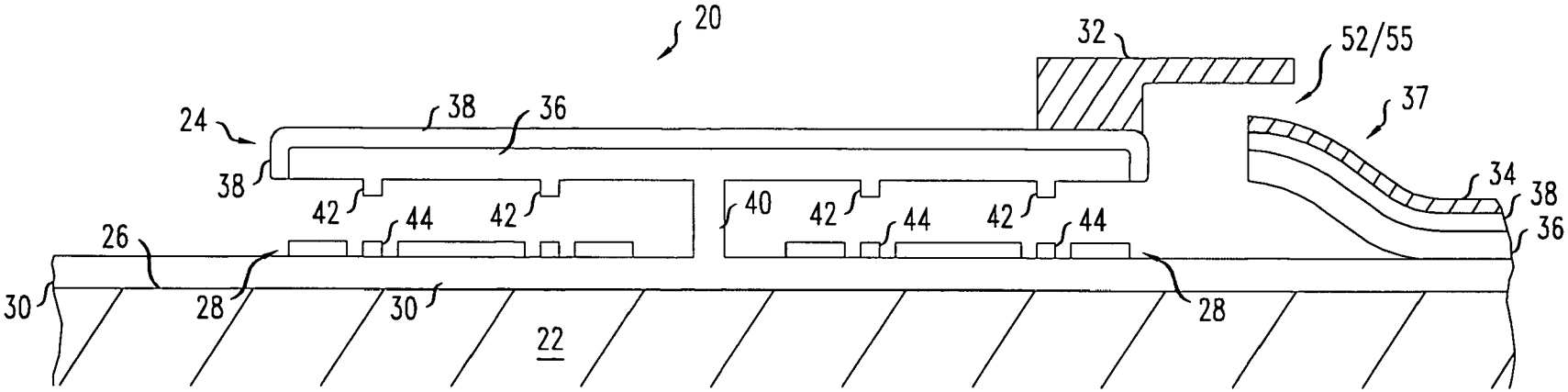
Figure 3:
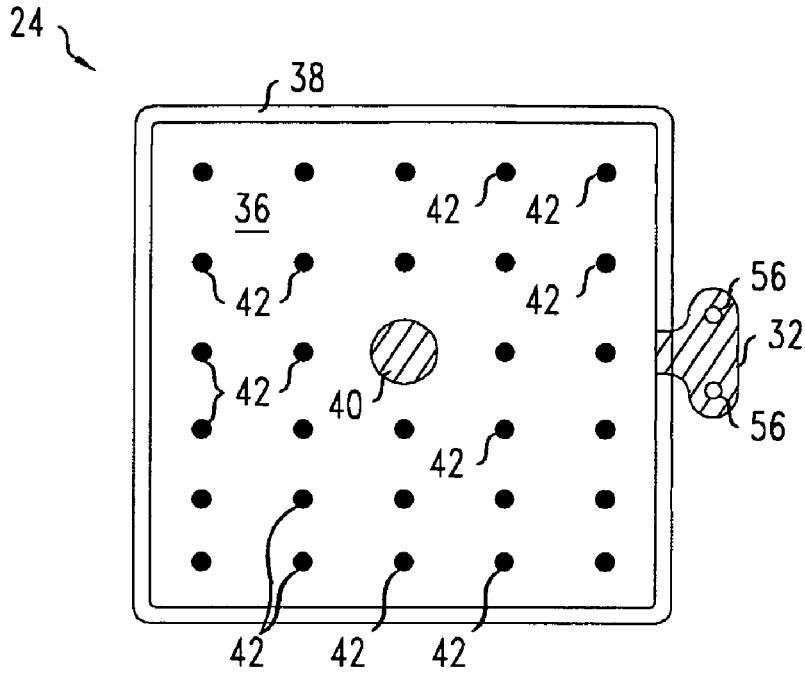
FIG. 3 is a bottom view illustrating the bilayers of the micro-mechanical switches of FIGS. 2A-2C.
Figure 4:
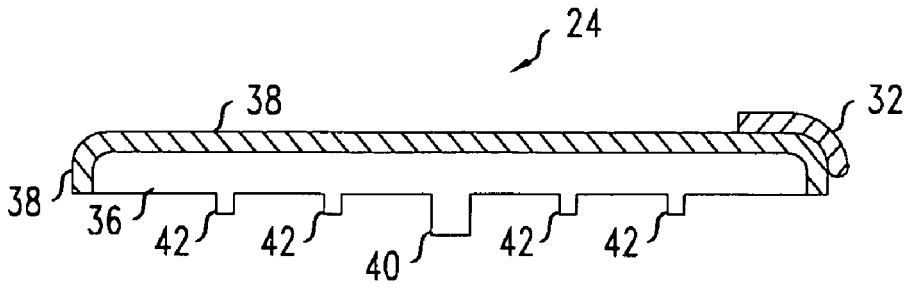
FIG. 4 is a cross-sectional view illustrating one vertical plane through an embodiment of the bilayers of FIGS. 2A-2C.

Referring to FIGS. 2A-2C, the conducting electrical jumper 32 is rigidly fixed to the top surface of the resilient bilayer 24 and overhangs one edge thereof, e.g., near the midpoint of said edge. In exemplary embodiments, the conducting electrical jumper 32 may be fabricated of a metal layer or a metal multilayer, e.g., a layer including gold (Au) and a bonding metal layer such as titanium (Ti). The conducting electrical jumper 32 is aligned to form an electrical short between the pair of connection pads 52, 54, i.e., shown in FIG. 5A, in response to the edge that the conducting electrical jumper 32 overhangs being pulled towards the connection pads 52, 54. That is, the conducting electrical jumper 32 closes the mechanical switch 20 by electrically shorting the two electrical lines 34 together. The conducting electrical jumper 32 may also include a pair of vertical projections 56 for contacting the connection pads 52, 54 when the mechanical switch 20 is in the closed state, i.e., when the corresponding edge of the bilayer 24 is forced towards the connection pads 52, 54.

The I/O electrical lines 34 are configured to connect external electrical leads (not shown) to the connection pads 52, 54 whose electrical state, i.e., electrically connected or disconnected, is controlled by the mechanical switch 20. The two I/O electrical lines 34 may include a metal layer, a metal multilayer, e.g., Au/Ti, and/or heavily n-type or p-type doped polysilicon.

Other embodiments of the mechanical switch 20 may use bilayers 24 whose lateral shapes are substantially polygons of various types. For example, the resilient bilayers 24 may be substantially regular polygons with 4, 6, or 8 sides. Other embodiments may use a stressed bilayer 24 of another shape as long as the bilayer has multiple stable curved states in which multiple edges are raised upwards.

The embodiments of FIGS. 2A-2C have different arrangements of the conducting electrical jumper 32 and the I/O electrical lines 34.

In the embodiment of FIG. 2A, the electrical jumper 32 applies a downward force on the connection pads 52, 54 of the I/O electrical lines 34 in the closed-switch state. The downward force is applied when the edge of the resilient bilayer 24, which the electrical jumper 32 overhangs, is curved. The downward force is produced, because the connector 40 is a compressive spring (CS) in this embodiment.

Figure 6A:
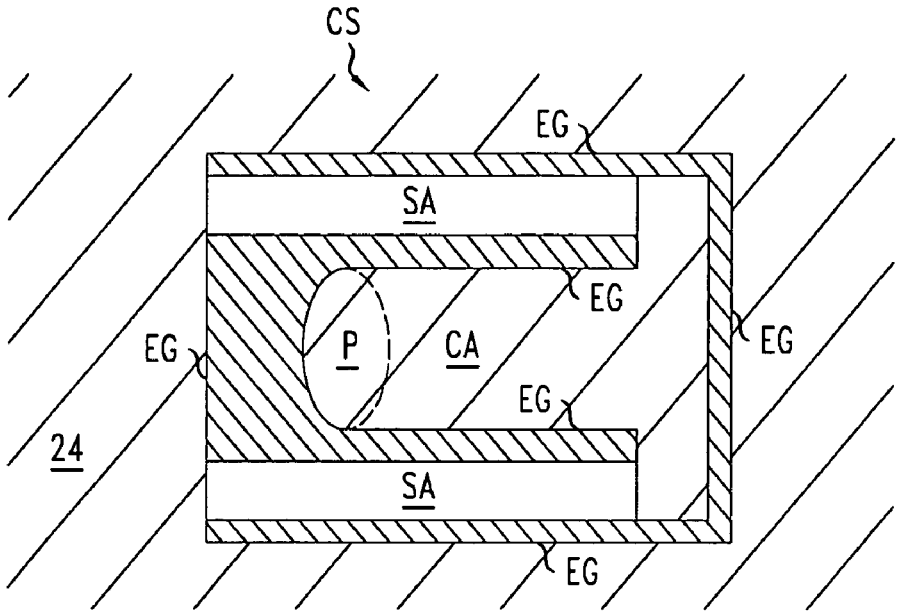
FIG. 6A is a top view of a compression spring (CS) that fixes the center of the bilayer to the substrate in the mechanical switch of FIG. 2A.
Figure 6B:
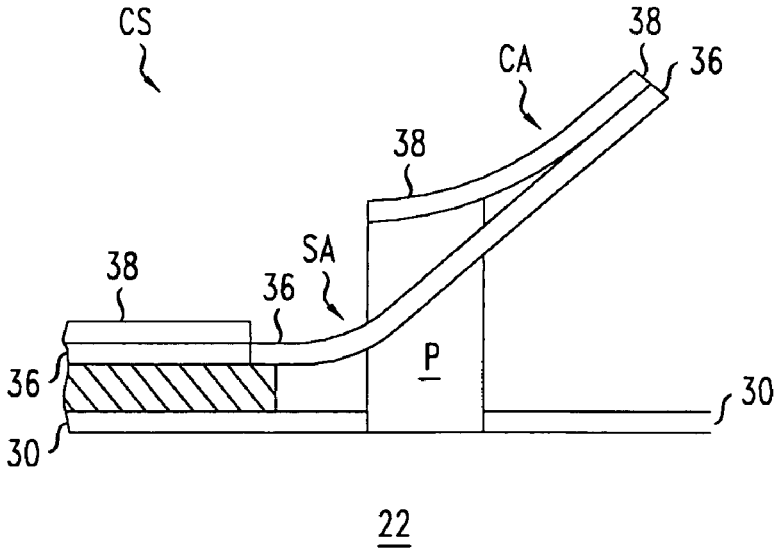
FIG. 6B is a side view of the compression spring (CS) of FIG. 6A that illustrates how the spring forces the center of the bilayer towards the substrate.

FIGS. 6A-6B illustrate one embodiment for such a compressive spring, CS. The compressive spring, CS, includes a post, P, a central arm, CA, and symmetrically located side arms, SA. The central arm, CA, connects between the top of the post, P, and one end of each side arm, SA. The central arm, CA, and the side arms, SA, can bend independently, because empty gaps (EGs) separate long lengths of the central arm, CA, and side arms, SA, from each other and from the resilient bilayer 24. The central arm, CA, includes, e.g., a top silicon nitride layer and a bottom doped polysilicon layer, i.e., the same layers as the resilient bilayer 24. Due to its geometry and attachment, the central arm, CA, is in a stable curved state such that the end of the central arm, CA, which is fixed to the post, P, is lower than the other end of the central arm, CA. The side arms, SD, are straight, e.g., not curved, because the side arms, SA, are single layered rather than bilayered. For example, the side arms, SA, may be made of the same doped polysilicon as the bottom conducting layer 36 of the resilient bilayer 24. The side arms, SA, might alternately be made of silicon nitride like the top dielectric layer 38 of the resilient bilayer 24. In that later case, the side arms, SA, may also be covered by a metal layer that provides a conducting bridge between the resilient bilayer 24, i.e., its conducting bottom layer 36, and the conducting doped polysilicon of the central arm, CA, and the post, P. Due to the curvature of the central arm, CA, and the longer length of the side arms, SA, the compression spring, CS, forces the far ends of the side arms, SA, towards the substrate 22. Since the bilayer 24 is fixed to the far ends of side arms, SA, the compression spring, CS, also pushes the attached center of the bilayer 24 towards the substrate 22.

In the embodiment of FIG. 2B, the electrical jumper 32 will apply an upward force on the connection pads 52, 54 of the I/O electrical lines 34 in the closed-switch state. Each connection pad 52, 54 is located on the underside of a corresponding metal structure 35. Each metal structures couples to a corresponding one of the electrical conducting lines 34 and vertically overhangs the conducting electrical jumper 32. During closing of the micro-mechanical switch of FIG. 2B, an upward force is applied to the metal structure 35 when the edge of the bilayer 24, which the electrical jumper 32 overhangs, is not curved. In this state, other edges of the bilayer 24 are in the stable curved state that corresponds to the closed-switch state and are close to the surface 26 of the substrate 22. During closing of the micro-mechanical switch 20 of FIG. 2B, the upward force is produced, because the curved state of the bilayer 24 pushes the edge that the electrical jumper 32 overlaps upwards in one of its stable curved states.

In the embodiment of FIG. 2C, the conducting electrical jumper 32 applies a downward force on the connection pads 52, 54 of the I/O electrical lines 34, because each connection pad 52 is located on a raised top portion of a corresponding bilayer structure 37. The two bilayer structures 37 may have the same bilayer construction as the bilayer 24, e.g., a top silicon nitride layer 38 on a bottom polysilicon layer 37. The free end portion of each bilayer structure 37 becomes arched during manufacture in response to removal of a sacrificial layer below said its end portion. In particular, the geometry of each bilayer structure 37 and its geometric fixation to the dielectric layer 30 cause the end portions to take the arched shape due to a net stress gradient therein when a sacrificial layer there below is removed.

Figure 5B:
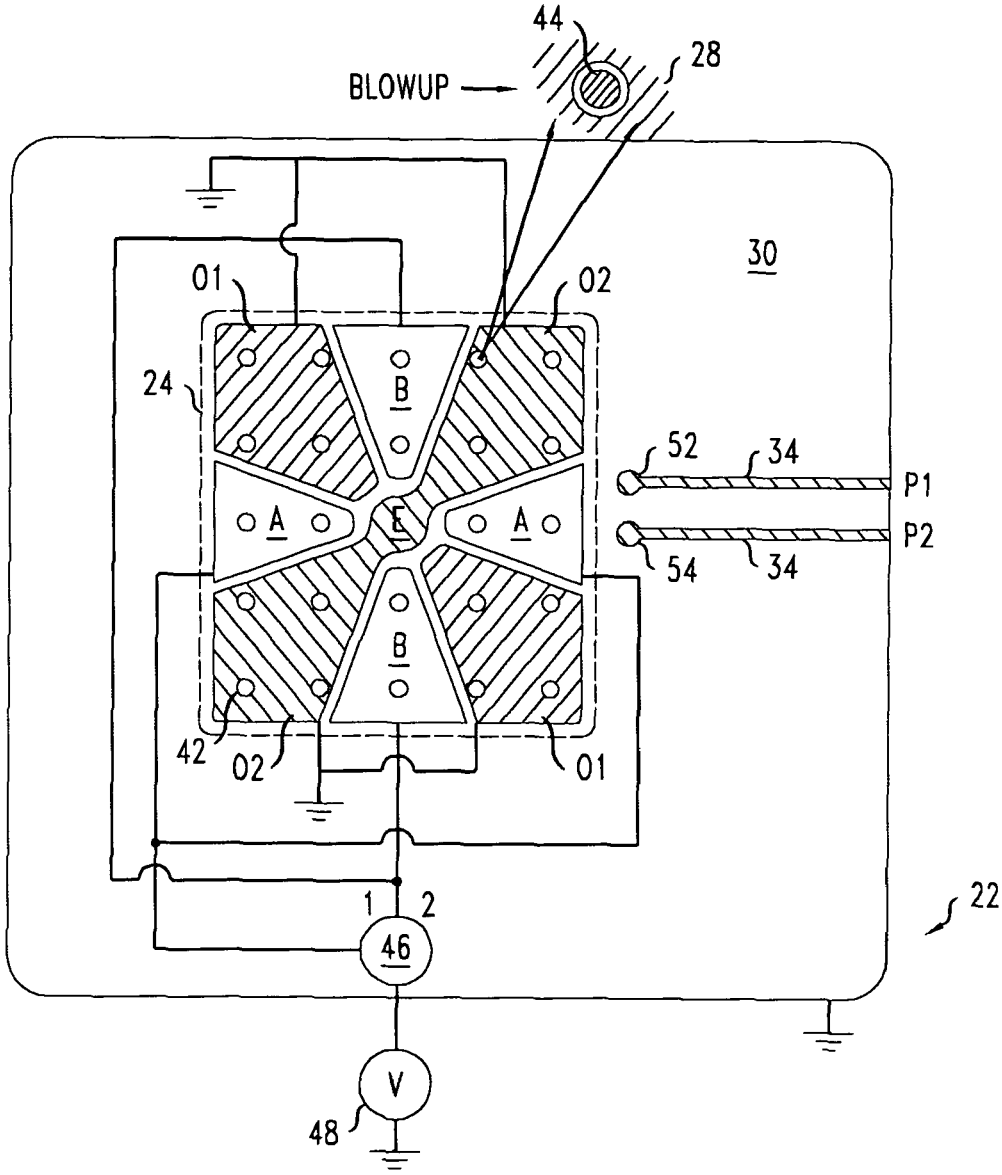
FIG. 5B is a top view of the surface that faces and is located below the bilayer in another embodiment of the micro-mechanical switches of FIGS. 2A-2C.

FIG. 5B illustrates an alternate embodiment of the control electrodes of the array 28 in a micro-mechanical switch similar to that of FIGS. 2A and 5A. The major differences between the micro-mechanical switches is that the conducting connector 40 does not penetrate the dielectric layer 30 in the switch of FIG. 5B unlike the micro-mechanical switches 20 of FIGS. 2A and 5A. Instead, the conducting connector 40 connects to a central conducting extension (E) of the control electrodes of one or both of the guard groups O1, O2. The conducting extension, E, and the conducting connector 40 form a conducting electrical path between the bottom conducting layer 36 of the resilient bilayer 24 and the control electrodes of the guard groups O1, O2. By this conducting electrical path, the bottom conducting layer 36 of the resilient bilayer 24 is grounded with the control electrodes of guard groups O1, O2.

Figure 7:
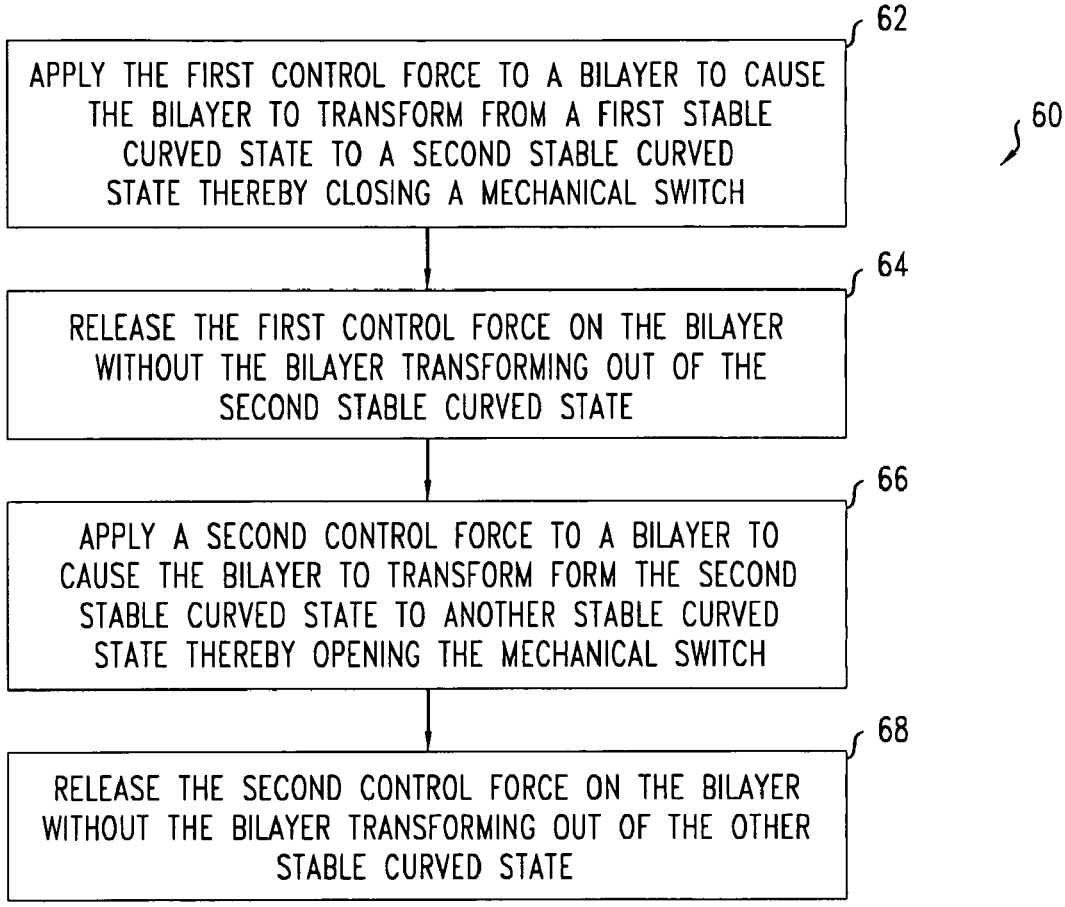
FIG. 7 is a flow chart illustrating a method of operating a micro-mechanical switch with a bilayer that has multiple stable curved states, e.g., the micro-mechanical switches of FIGS. 2A-2C.

FIG. 7 illustrates a method 60 for operating a micro-mechanical switch that includes a resilient bilayer having a conducting bottom layer, e.g., the bilayer 24. The resilient bilayer has two or more stable curved states and may be substantially polygonal in shape. In each of the stable curved state, different edges of the bilayer are curved. The resilient bilayer is also attached to a substrate by a conducting connector, e.g., the connector 40. For example, the method 60 may operate the bilayer-based mechanical switches 20 of FIGS. 2A-2C.

The method 60 includes applying a first control force to the resilient bilayer to cause the bilayer to transform from a first stable curved state to a different second stable curved state (step 62). The first control force may be, e.g., an electrostatic force produced by charged control electrodes located near the conducting layer of the bilayer. The control electrodes may be located near midregions of a pair of opposite edges of the bilayer, e.g., like the control electrodes of operating group A or B in FIGS. 5A-5B. In the second stable curved state, a conducting jumper on the bilayer electrically shorts two I/O electrical contacts or lines thereby closing the mechanical switch. For example, each of the bilayers 24 of FIGS. 2A-2C has the conducting electrical jumper 32 that electrically shorts the I/O electrical lines 34 in one of the stable curved states of the resilient bilayer 24.

The method 60 may include releasing the first control force such that the bilayer remains in the second stable curved state without further application of control force thereto (step 64). That is, the bilayer may latch into the second stable curved state so that power is not expended to keep the switch closed after its transformation to the closed-switch state. The method 60 may include then, transmitting an electrical current through the micro-mechanical switch while the bilayer is in the second stable curved state.

The method 60 includes applying a second control force to the resilient bilayer such that the bilayer transforms from the second stable curved state to another stable curved state (step 66). The other stable curved state can be the first stable curved state or another stable curved state that is not the second stable curved state. The state-transformation opens the mechanical switch, because the conducting electrical jumper on the bilayer does not electrically short the I/O conducting electrical lines or contacts in a stable curved state that is different from the second stable curved state. The second control force may be an electrostatic force produced by charging other control electrodes. For example, the control electrodes applying the second control force may be those of the operating group B in FIG. 5A of 5B if the control electrodes that applied the first control force were those of the operating group A. The applications of the first and second forces are such that the edge of the bilayer that has the conducting jumper is curved in one of the first and second stable curved states and is substantially uncurved in the other of the first and second stable curved states.

In some embodiments, the method 60 may include releasing the second control force such that the bilayer remains in the other stable curved state (step 68). That is, the bilayer may latch into the other stable curved state so that power is not expended to keep the switch open after its transformation to the open-switch state.

Figure 8:
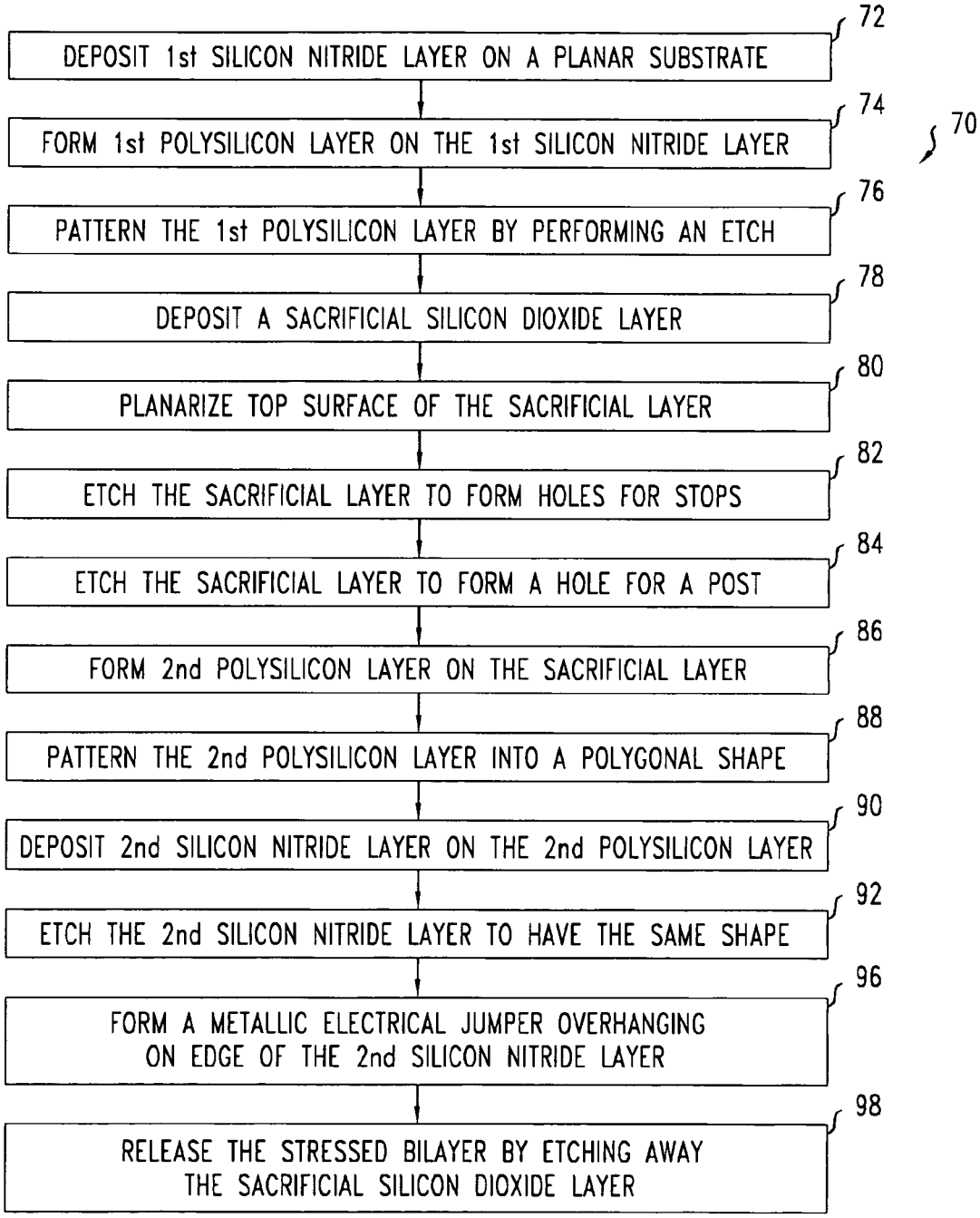
FIG. 8 is a flow chart illustrating a method for manufacturing a micro-mechanical switch in which different switch states are associated with different stable curved states, e.g., to make embodiments of the micro-mechanical switches of FIGS. 2A-2C.
Figure 9:
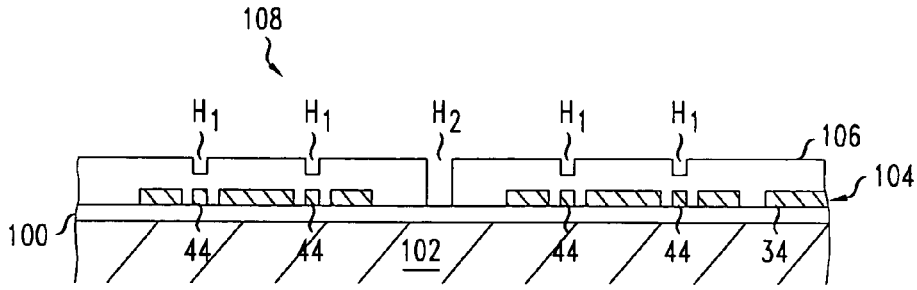
FIGS. 9-11 are cross-sectional views of intermediate structures fabricated during the performance of various embodiments of the method of FIG. 8.
Figure 11:
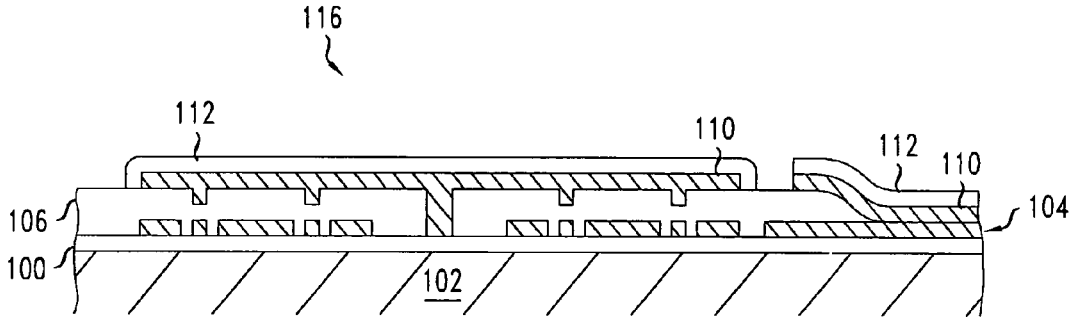
Figure 10:
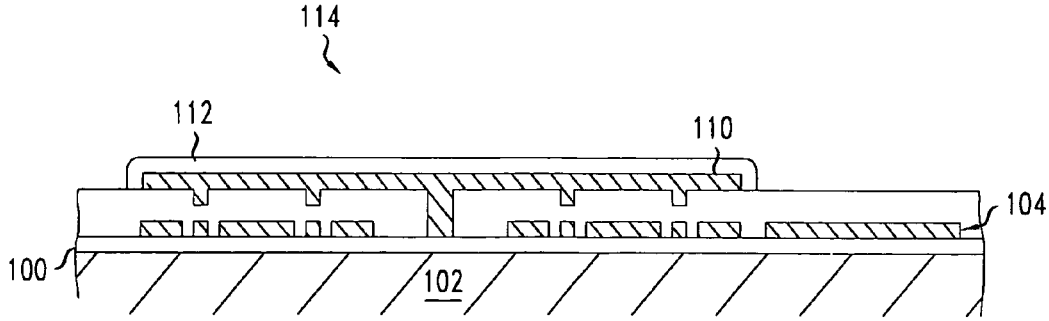

FIG. 8 illustrates a method 70 for fabricating micro-mechanical switches whose open and closed switch-states correspond to different stable curved states of resilient bilayers therein. Various embodiments of the method 70 can fabricate, e.g., the micro-mechanical switches 20 as shown in FIGS. 2A-2C. Various embodiments of the method 70 can produce intermediate structures 108, 114, 116 as illustrated in FIGS. 9-11.

The method 70 includes depositing a first silicon nitride layer 100 on a planar top surface of a substrate 102, e.g., a crystalline silicon substrate, via a conventional process (step 72). The deposited first silicon nitride layer 100 may have a thickness of about 0.3 μm to about 1.0 μm, i.e., about 0.5 μm of $Si_3N_4$.

The method 70 includes forming a first heavily p-type or n-type doped polysilicon layer 104 on the first silicon nitride layer 100 via a conventional process (step 74). The first polysilicon layer 104 may have a thickness of about 1 μm to about 3 μm.

The method 70 includes performing a mask-controlled dry or wet etch that laterally patterns the first polysilicon layer 104 (step 76). The etch is selected, e.g., to stop on the underlying first silicon nitride layer 100. The etch separates the first polysilicon layer 104 into disconnected lateral regions. The separate lateral regions may include, e.g., the control electrodes in the array 28, the I/O electrical lines 34, the raised areas 44, and the connection pads 52, 54 as shown in FIG. 5A or 5B.

In some embodiments, the method 70 may include performing a mask-controlled vapor-deposition of metal on a portion of the first polysilicon layer 104. Such a metal deposition may produce, e.g., metallic I/O electrical lines 34 and connection pads 52, 54 for the micro-mechanical switches 20 of FIGS. 2A and 2B.

The method 70 includes performing a conventional process to deposit a silicon dioxide layer 106 over the first polysilicon layer 104 and exposed parts of the first silicon nitride layer 100 (step 78). The silicon dioxide layer 106 is a sacrificial layer that will be use to aid in the fabrication of other structures, but will be removed from the final micro-mechanical switch.

The method 70 may include planarizing the surface of the deposited silicon dioxide layer 106 to produce a smooth top surface for use in further fabrication (step 80). The planarization may involve performing a chemical mechanical planarization (CMP) that is selective for silicon dioxide. The final flat silicon dioxide layer 106 may have, e.g., a thickness of about 1 μm to about 5 μm.

The method 70 includes performing a conventional mask-controlled dry etch of the silicon dioxide layer 106 to produce holes, H1, for forming short stops for the resilient bilayer therein, e.g., the stops 42 of FIGS. 2A-2C, 3, and 4 (step 82). The etch is timed, e.g., to stop prior to traversing the silicon dioxide layer 106.

The method 70 includes performing a second conventional mask-controlled dry etch of the silicon dioxide layer 106 to form a hole, H2, for a post therein, e.g., a post for the conducting connector 40 of FIGS. 2A-2C (step 84). This etch step may also include forming a hole (not shown) in the silicon dioxide layer for later forming the tip of the conducting electrical jumper 32 of FIG. 2A. The etchant may be selected to stop on the underlying substrate 1O2. In other embodiments, the etch step 84 may alternatively be configured to stop on the first silicon nitride layer 100, e.g., to form a micro-mechanical switch 20 as illustrated by FIG. 5B.

The first and second etch steps 82 and 84 use masks with windows that are suited for the desired feature holes H1, H2. The etching steps 82 and 84 produce the intermediate structure 108 as shown in FIG. 9.

The method 70 includes forming a heavily p-type or n-type doped second polysilicon layer 110 on the silicon dioxide layer 106 of the intermediate structure 108 (step 86). The formation step 86 may include depositing doped polysilicon and then, performing a conventional planarization, e.g., a CMP selective for polysilicon. The second polysilicon layer 110 may have an exemplary thickness of about 1 μm to about 3 μm. Part of the formed second polysilicon layer 110 may also be directly on the underlying first polysilicon layer 104, e.g., as shown in FIG. 11.

The method 70 includes performing a conventional mask-controlled etch to pattern the second polysilicon layer 110 to produce a resilient bilayer with a substantially polygonal shape therein, e.g., the resilient bilayer 24 of FIGS. 2A-2C and 3-4 (step 88). To make the mechanical switch 20 of FIG. 2A, the patterning may also produce a set of gaps, EG, in the second polysilicon layer 112 as shown in FIG. 6A. Such gaps may be made for forming the compression spring, CS, of FIGS. 6A and 6B. The etch step 88 may alternately include patterning a second portion of the second polysilicon layer 110 to make bottom layer 36 of the bilayer structures 37 shown FIG. 2C. This second portion of the second polysilicon layer 110 is fabricated to be partly on the silicon dioxide layer 106 and partly off the silicon dioxide layer 106. That is, part of the second portion of the second polysilicon layer 110 is directly on the underlying first polysilicon layer 104 or directly on the first silicon nitride layer 100.

The method 70 includes depositing a conformal second silicon nitride layer 112 over the second polysilicon layer 110 (step 90). The second silicon nitride layer 112 can have an exemplary thickness of about 0.3 μm to about 1.0 μm, e.g., 0.5 μm.

The method 70 includes performing a mask-controlled etch of the second silicon nitride layer 112 to form either intermediate structure 114 of FIG. 10 or intermediate structure 116 of FIG. 11 (step 92). In the intermediate structure 114 of FIG. 10, the second silicon nitride layer 112 has been laterally patterned to have approximately the same shape as the second polysilicon layer 110, e.g., to produce a substantially polygonal shaped resilient bilayer 24 as in FIGS. 3 and 4. In the intermediate structure 116 of FIG. 11, the lateral patterning has produced both the substantially polygonal-shaped resilient bilayer 24 of FIGS. 2A-2C, 3, and 4 and the shaped bilayer structures 37 of FIG. 2C.

In embodiments that fabricate the micro-mechanical switch 20 of FIG. 2A, the etching step 92 may also selectively remove the second silicon nitride layer 112 from side arms, SA, and gaps, EG, in a central area of the substantially polygon-shaped resilient bilayer 24. These patterned features would be aligned with gaps, EG, patterned through the second polysilicon layer 110 and would be configured as in the compression spring, CS, of FIG. 6A.

To form the mechanical switch 20 of FIG. 2A, the method 70 also includes performing a mask-control etch of a portion of the second silicon dioxide layer 106 adjacent the right edge of the bilayer 110, 112 to produce one or more holes therein. The one or more holes are sized to be suitable for a subsequent formation of the vertical projection 56 of the conducting electrical jumper 32 therein.

The method 70 includes forming a metallic electrical jumper overhanging one patterned edge of the second silicon nitride layer 112, e.g., the conducting electrical jumper 32 of FIGS. 2A-2C (step 96). The metal for the metallic electrical jumper may be deposited by a conventional mask-controlled vapor-deposition of metal and a subsequent lift off of excess metal that is located on the mask. The metal of the metallic electrical jumper may alternatively be deposited by a conventional electroplating process. Exemplary metals for the metallic electrical jumper include Au/Ti, but other metal combinations may also be used. In embodiments to fabricate the mechanical switch 20 of FIG. 2A, the exposed parts of the connection pads 52, 54 may be protected by a thin photoresist layer, e.g., during the formation of this metal embodiment of the conducting electrical jumper 20.

To form the mechanical switch 20 of FIG. 2B, the method 70 may also include performing a sequence of steps to make the two metallic structures 35 for the connection pads 52, 54 (See also, FIG. 5A). The sequence may include forming a second sacrificial silicon dioxide layer over the previous intermediate structure and planarizing the second silicon dioxide layer. The sequence may include then, performing a dry etch to produce two vias that traverse the second silicon dioxide layer and stop on the conducting I/O electrical lines 34 and then, filling the vias with metal to produce metallic posts in contact with the conducting I/O electrical lines 34. Finally, the sequence may include performing a mask-controlled vapor-deposition of metal and a lift off of excess metal on the top surface of the second sacrificial layer. This last step would produce the upper horizontal portions of the metallic structures 35 in contact with the metal-filled vias. A subsequent removal of the second sacrificial silicon dioxide layer should then, produce the vertical metallic structures 35 for the connection pads 52, 54 as shown in FIG. 2B.

To form the mechanical switch 20 of FIG. 2C, the step 96 may include performing a sequence of steps to fabricate the conducting electrical jumper 32. The sequence may include forming a second sacrificial silicon dioxide layer over the intermediate structure 116 that was produced at step 94 and planarizing the second silicon dioxide layer. The sequence may include then, performing a dry etch to produce a via that traverses the second sacrificial layer and that stops on the second silicon nitride layer 112 near an edge of the bilayer 24 and then, performing a mask-controlled metal deposition to produce a metal post that fills the via. The sequence may include performing a mask-controlled metal deposition and lift off of the excess metal on the second sacrificial layer to produce the upper horizontal portion of the conducting electrical jumper 32 on and in contact with the metal-filled via. Subsequent removal of the second sacrificial layer should produce a metal embodiment of the conducting electrical jumper 32 as shown in FIG. 2C.

Finally, the method 70 includes physically releasing the resilient bilayer by performing an etch that removes the sacrificial silicon dioxide layer or layers, e.g., layer 106 (step 98). This etch may be a wet etch with an aqueous solution of HF.

Besides releasing the bilayer 24, the removal of the sacrificial oxide will produce the metallic connection structures 35 of FIG. 2B and will cause the ends of the bilayer structures 37 to spring up as shown in FIG. 2C.

In other embodiments of methods for fabricating micro-mechanical switches, e.g., the micro-mechanical switches 20 of FIGS. 2A-2C, other materials may be substituted for materials used in above-described method 70. For example, these other methods may replace the specific semiconductor(s), metal(s), and/or dielectric(s) of the above method 70 by other functionally and/or structurally similar materials that would be known to be suitable replacements by those of skill in the micro-electronics art or by those of skill the micro-electro-mechanical systems (MEMS) art.

From the above disclosure, the figures, and the claims, other embodiments will be apparent to those of skill in the art.

What we claim is:

1. An apparatus, comprising:

a mechanical switch including a bilayer having first and second stable curved states, the bilayer flexed along an axis in the first state and flexed along a different, non-parallel axis in the second state; and wherein a transformation of the bilayer from the first state to the second state closes the switch, and wherein the bilayer is capable of remaining in the first stable curved state and capable of remaining in the second stable curved state in the absence of a control force.

2. The apparatus of claim 1, wherein the bilayer has a substantially polygonal shape with an even number of edges.

3. The apparatus of claim 2, wherein the polygonal shape has four or six edges.

4. The apparatus of claim 3, wherein the edges are shorter than about 500 micrometers.

5. The apparatus of claim 1, wherein the bilayer has a conducting surface.

6. The apparatus of claim 5, further comprising a first electrode facing a surface of the bilayer and a second electrode facing a surface of the bilayer.

7. The apparatus of claim 6, wherein the bilayer is configured to transform to the first state in response to a voltage being applied between the bilayer and the first electrode; and wherein the bilayer is configured to transform to the second state in response to a voltage being applied between the bilayer and the second electrode.

8. The apparatus of claim 1, wherein the control force includes an electrostatic force.

9. An apparatus, comprising:

a substrate having a top surface;

a plurality of electrodes being located along the top surface and being fixed to the substrate; and a bilayer physically attached by a connector to the substrate, the bilayer being capable of transforming between first and second stable curved states, the bilayer having different edges that are curved in the first and second states, wherein the bilayer is flexed along an axis in the first state and flexed along a different, non-parallel axis in the second state and wherein the bilayer is capable of remaining in the first stable curved state and capable of remaining in the second stable curved state in the absence of a control force.

10. The apparatus of claim 9, further comprising:

an electrical jumper located on the bilayer; and first and second electrical lines located over the top surface and fixed to the substrate; and wherein the electrical jumper is configured to electrically connect the lines in response to the bilayer being in the first curved state and to not short the lines in response to the bilayer being in the second curved state.

11. The apparatus of claim 10, wherein one pair of the electrodes is configured to pull portions of a first pair of edges of the bilayer towards the top surface and another pair of the electrodes is configured to pull portions of a second pair of edges of the bilayer towards the top surface.

12. The apparatus of claim 11 wherein the edges of the first pair are alternated with the edges of the second pair along a perimeter of the bilayer.

13. The apparatus of claim 11, wherein the bilayer has a substantially rectangular shape.

14. The apparatus of claim 9, wherein the control force includes an electrostatic force.

* * * * *